US008773278B2

(12) United States Patent
Contant et al.

(10) Patent No.: US 8,773,278 B2
(45) Date of Patent: Jul. 8, 2014

(54) APPARATUS FOR RECEIVING AND TRANSMITTING SIGNALS IN ELECTROMAGNETIC TELEMETRY SYSTEM USED IN A WELLBORE

(75) Inventors: Matthe Contant, Sandvika (NO); Yves G. Mathieu, Les Ulis (FR); Erwann Lemenager, Paris (FR); Juergen Zach, Bad Kotzting (DE)

(73) Assignee: Schlumberger Technology Corporation, Sugar Land, TX (US)

( * ) Notice: Subject to any disclaimer, the term of this patent is extended or adjusted under 35 U.S.C. 154(b) by 1042 days.

(21) Appl. No.: 12/809,622

(22) PCT Filed: Dec. 18, 2008

(86) PCT No.: PCT/EP2008/010827

§ 371 (c)(1),
(2), (4) Date: Oct. 26, 2010

(87) PCT Pub. No.: WO2009/080284

PCT Pub. Date: Jul. 2, 2009

(65) Prior Publication Data

US 2011/0032117 A1 Feb. 10, 2011

Related U.S. Application Data

(60) Provisional application No. 61/016,217, filed on Dec. 21, 2007.

(51) Int. Cl.
*G01V 3/00* (2006.01)

(52) U.S. Cl.
USPC ..... 340/854.3; 166/250.01

(58) Field of Classification Search
USPC ..... 340/854.3–854.6; 166/250.01
See application file for complete search history.

(56) References Cited

U.S. PATENT DOCUMENTS

| | | | | |
|---|---|---|---|---|
| 6,396,276 | B1 * | 5/2002 | Van Steenwyk et al. | 324/366 |
| 6,445,307 | B1 * | 9/2002 | Rassi et al. | 340/854.6 |
| 7,117,944 | B2 * | 10/2006 | Boyadjieff | 166/302 |
| 7,326,015 | B2 * | 2/2008 | Reynolds, Jr. | 411/424 |
| 7,861,779 | B2 * | 1/2011 | Vestavik | 166/277 |

FOREIGN PATENT DOCUMENTS

| | | |
|---|---|---|
| EP | 1748151 | 1/2007 |
| GB | 2436578 | 10/2007 |

* cited by examiner

*Primary Examiner* — Albert Wong
(74) *Attorney, Agent, or Firm* — Cameron R. Sneddon

(57) ABSTRACT

A downhole electromagnetic telemetry unit for use with a tubing string (5) includes an insulated electrically conductive member (31) and a processing unit (15). The insulated electrically conductive member (31) is electrically coupled to the tubing string (5) at an upper measuring point (23) and a lower measuring point (25). The processing unit (15) is configured to process a voltage difference measured between the upper measuring point (23) and the lower measuring point (25) across the insulated electrically conductive member (31) and to derive therefrom a signal transmitted from a surface location (13).

8 Claims, 4 Drawing Sheets

APPARATUS FOR RECEIVING AND TRANSMITTING SIGNALS IN ELECTROMAGNETIC TELEMETRY SYSTEM USED IN A WELLBORE

CROSS-REFERENCE TO RELATED APPLICATIONS

This application claims priority to U.S. Provisional Application 61/016,217 filed on Dec. 21, 2007, which is incorporated herein by reference.

BACKGROUND OF INVENTION

1. Field of the Invention

The invention relates generally to an electromagnetic wireless telemetry system used in a wellbore to communicate between equipment at the surface and a downhole tool positioned in the wellbore.

2. Background Art

A variety of techniques are currently used in the oilfield in order to communicate between the surface and downhole tools or sensors disposed in the wellbore. One such technique is wireless electromagnetic telemetry in which electromagnetic waves are transmitted through the earth and casing in the wellbore. Examples of electromagnetic telemetry systems are disclosed in U.S. Pat. Nos. 5,642,051 and 5,396,232, both of which are assigned to the assignee of the present invention.

FIG. 1 shows a schematic of an electromagnetic telemetry system. To communicate from the surface to a downhole tool 2 located in the wellbore 1 and connected to a tubing string 5, a modulated current is applied using a current source 7, which is electrically connected to a wellhead (not shown) and an electrically conductive ground member 13 staked into the ground 11 some distance away from the wellhead. A circuit is formed using the ground 11 and casing 3 disposed in the wellbore 1. To receive information from the surface, a processing unit 15 receives the signal in the form of a voltage difference between two points on the casing 3: an upper point 17 and a lower point 19. The measured voltage difference may be very small, for example, in the order of a microvolt. The processing unit 15 amplifies this signal, decodes it, and then communicates with the downhole tool 2, which takes action based on the received signal.

Sending information from the downhole tool 2 and the surface works in the reverse manner from that described above. The processing unit 15 may include a transmitter or transceiver to send signals to the surface. Current from the processing unit 15 is injected into the formation surrounding the casing 3 through two injection points on the casing 3, which can be the same points as the upper measuring point 17 and the lower measuring point 19. Specific coding of the current signal carries the information from downhole to the surface. At the surface, the current is measured as a voltage difference between the wellhead and a second point on the ground.

The two points on the casing must be separated by some amount of electrical resistance to provide a measurable voltage difference. One related art method is to provide an insulated gap in the tubing string between the two points, as shown in FIG. 2A. The insulated gap 21 is a section in the tubing where the upper part of the tubing is electrically insulated from the lower part of the tubing. It may be for example an insulated threaded connection in the tubing string 5. To receive a signal, the voltage difference is measured at an upper measuring point 23 above the insulated gap 21 and a lower measuring point 25 below the insulated gap 21. The tubing string 5 makes contact with the casing 3 above and below the insulated gap 21 at contact points 17 and 19, which are space apart. To transmit a signal, current can be injected at the same measuring points 23, 25. Electromagnetic telemetry systems using insulating gaps are disclosed in U.S. Pat. No. 7,080,699, which is assigned to the assignee of the present invention.

Another related art method is to provide two centralizers on the tubing string in order to provide two contact points with the casing some distance apart. Such a system is shown in FIG. 2B. An upper centralizer 27 and a lower centralizer 29 are disposed on the tubing string 5 and contact the casing 3 at points 17, 19. The upper measuring point 23 and the lower measuring point 25 are respectively located at the upper centralizer 27 and the lower centralizer 29 thus generating fixed measuring points. A cable (not shown) runs from the two measuring points 23, 25 to the processing unit used to communicate with the downhole tool. However, centralizers are expensive.

SUMMARY OF INVENTION

In a first aspect, the invention relates to a downhole electromagnetic telemetry unit for use with a tubing string, the downhole electromagnetic telemetry unit comprising an insulated electrically conductive member electrically coupled to the tubing string at an upper measuring point and a lower measuring point, and a processing unit configured to process a voltage difference measured between the upper measuring point and the lower measuring point across the insulated electrically conductive member and to derive therefrom a signal transmitted from a surface location.

In a second aspect, the invention relates to a telemetrically controlled downhole tool configured to connect to a tubing string and comprising the downhole electromagnetic telemetry unit according to the first aspect, wherein the downhole tool is configured to be actuated by the signal.

In a third aspect, the invention relates to a system for communicating signals between a surface and a downhole electromagnetic telemetry unit in a wellbore having a casing and a tubing string disposed in the casing, the system comprising the downhole electromagnetic telemetry unit according to the first aspect, wherein the processing unit is configured to transmit a signal by applying a voltage difference between the upper measuring point and the lower measuring point across the insulated electrically conductive member, the system further comprising an electrically conductive ground member located at a distance from a wellhead disposed above the wellbore, and a surface processing unit configured to process a voltage difference measured between the wellhead and the electrically conductive ground member and to derive therefrom the signal transmitted from the downhole electromagnetic telemetry unit.

In a fourth aspect, the invention relates to a downhole electromagnetic telemetry unit for use with a tubing string, the downhole electromagnetic telemetry unit comprising an insulated electrically conductive member electrically coupled to the tubing string at an upper measuring point and a lower measuring point, and a processing unit configured to transmit a signal by applying a voltage difference between the upper measuring point and the lower measuring point across the insulated electrically conductive member.

In a fifth aspect, the invention relates to a method of transmitting a signal between a surface and a down-hole tool in a wellbore, the wellbore including a casing and a tubing string disposed in the casing, the method comprising applying a modulated voltage carrying the transmitted signal from the surface between a surface location and the casing using an electrically conductive ground member located at the surface location at a distance from the casing, detecting a voltage difference using an electrically conductive member disposed between at least two measuring points on the tubing, and processing the detected voltage difference to obtain the transmitted signal.

In a sixth aspect, the invention relates to a method of transmitting a signal between a downhole tool in a wellbore and a surface, the wellbore including a casing and a tubing string disposed in the casing, the method comprising applying a modulated current carrying the transmitted signal from the downhole tool to an electrically conductive member disposed between at least two measuring points on the tubing, detecting a voltage difference between the casing and a surface location at a distance from the casing, and processing the detected voltage difference to obtain the transmitted signal from the downhole tool.

Other aspects, characteristics, and advantages of the invention will be apparent from the following detailed description.

BRIEF DESCRIPTION OF DRAWINGS

Advantages and characteristics of the present invention will be apparent from the following detailed description, referring to the figures in which.

DETAILED DESCRIPTION

In one aspect, embodiments of the invention relate to an electromagnetic wireless telemetry system used in a wellbore to communicate between equipment at the surface and a downhole tool positioned in the wellbore.

Figure 1:
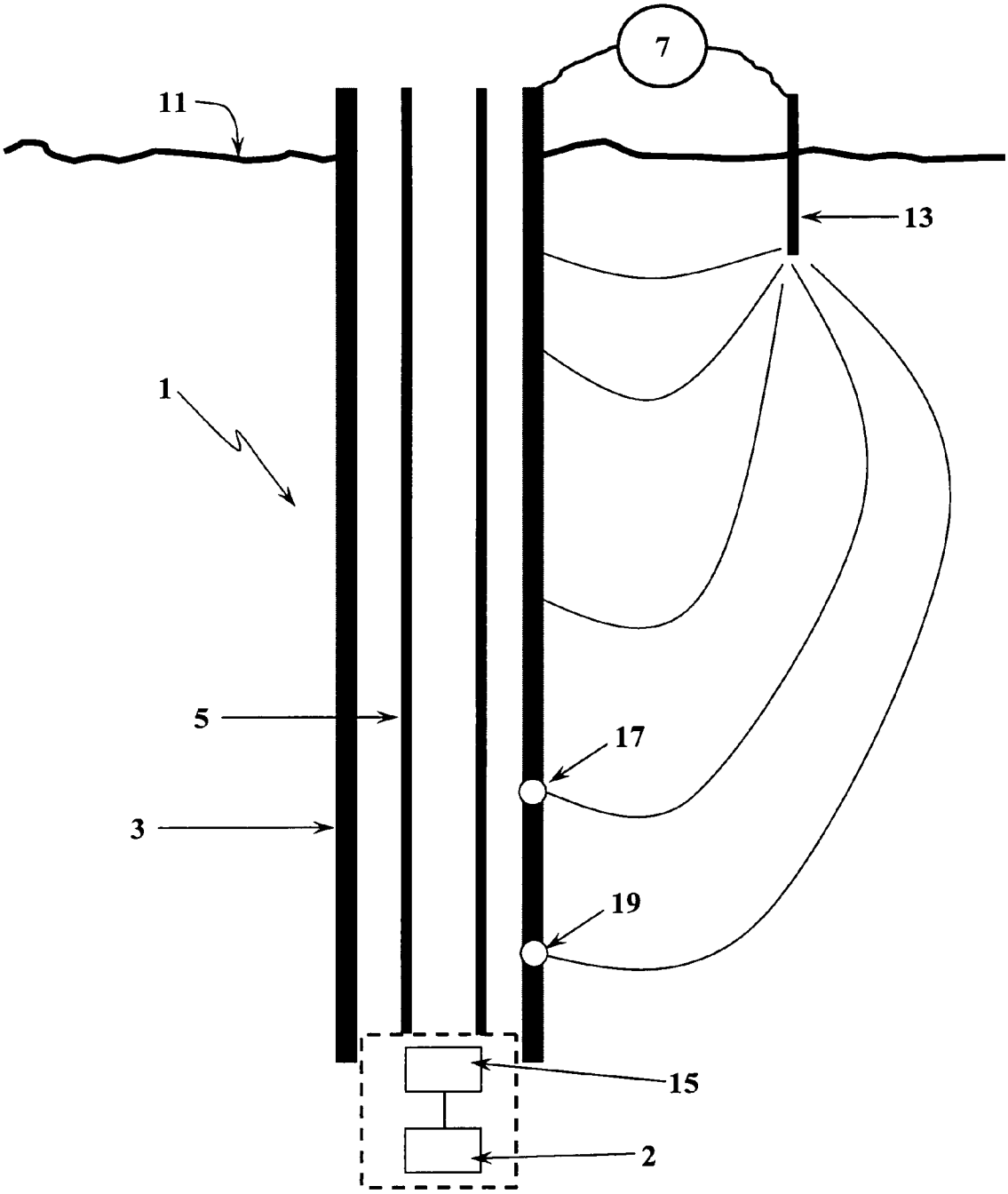
FIG. 1 is a schematic of a well in which electromagnetic telemetry is used.
Figure 2A:
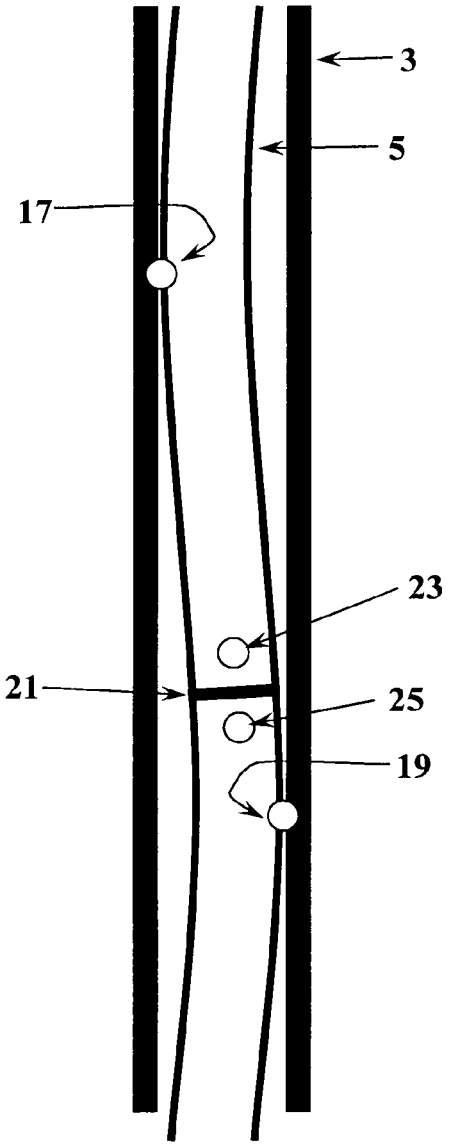
FIGS. 2A and 2B show schematics of two prior art methods for measuring a voltage difference.
Figure 2B:
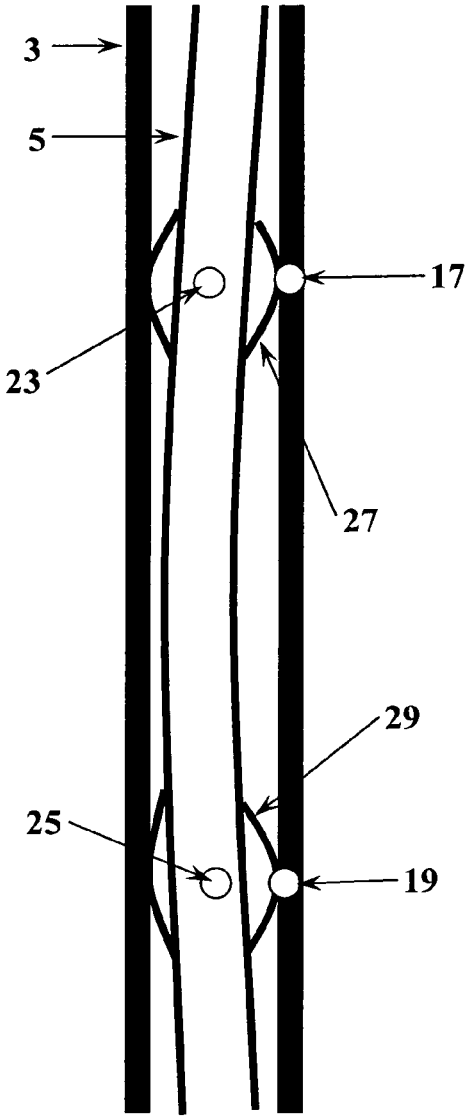
Figure 3:
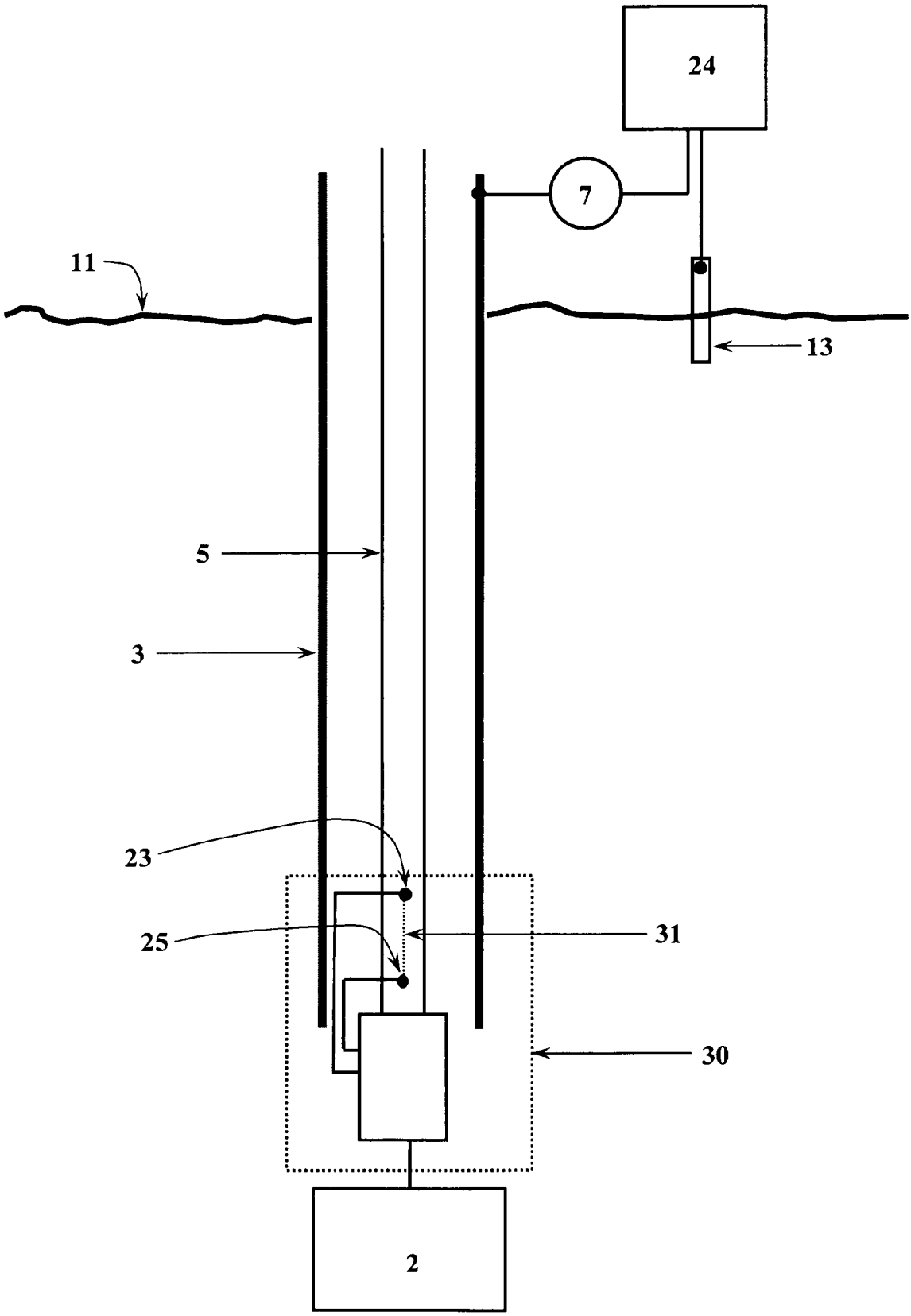
FIGS. 3 and 4 show schematics of an electromagnetic telemetry system in accordance with an embodiment of the present invention.
Figure 4:
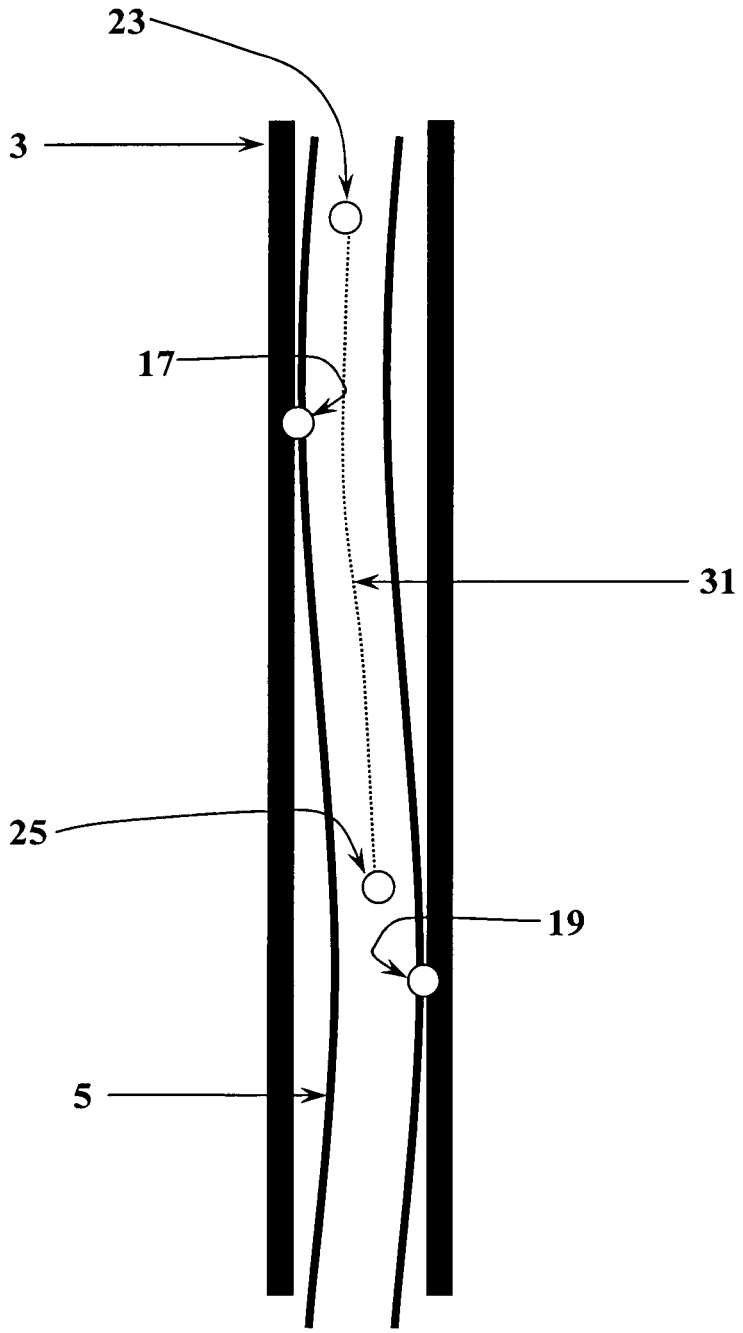

FIGS. 3 and 4 show a schematic of an electromagnetic telemetry system in accordance with an embodiment of the present invention. A modulated current is injected into the ground 11 through the electrically conductive ground member 13. The current is provided by the current source 7 and modulated into a signal by a surface processing unit 24. To receive the signal, an insulated, electrically conductive member 31 is provided in the tubing string 5 and electrically connected to the tubing string 5 at an upper tubing measuring point 23 and a lower tubing measuring point 25. The insulated, electrically conductive member 31 may be, for example, a mono conductor cable with an electrically insulated jacket. The electrical connection between the tubing string 5 and the conductive member 31, at the tubing measuring points 23, 25 should have a low resistivity. Suitable electrical connections may be provided by, for example, a clamp made of metal, such as stainless steel.

The upper and lower tubing measuring points 23, 25 are electrically connected to the tubing string 5. Because the tubing string 5 is in contact with the casing 3 by means of the casing measuring points 17, 19 (FIG. 4), the tubing measuring points also measure the voltage difference over the casing measuring points 17, 19. The tubing touches the casing above and below the tubing measuring points; hence it can be considered that the tubing and casing measuring points are the same, providing the distance between the tubing measuring points is not too short.

The voltage difference between the upper measuring point 23 and the lower measuring point 25 is measured and processed by a processing unit 30, which may be separate from or a component in the downhole tool 2. An end of the conductive member 31 may be connected to a housing of the downhole tool 2, such that the housing is the lower measuring point 25. The points on the casing 3 that are actually measured will be those located closest to the respective measuring points 23, 25 on the tubing string 5.

As the distance between the upper measuring point 23 and the lower measuring point 25 increases, the resistivity increases and thus the measured voltage difference increases. Accordingly, to increase signal strength, the distance between the upper measuring point 23 and the lower measuring point 25 can be increased. Because the conductive member 31 can be a relatively inexpensive conductor cable, the increase in length and its corresponding signal strength can be economically provided. The distance between the upper measuring point 23 and the lower measuring point 25 may be greater than about 5 meters. In one embodiment, the distance may be between about 10 meters and 200 meters. The corresponding improvement in signal strength occurs for both receiving and sending signals between the surface and the processing unit 30, which may be configured to be a receiver and/or a transmitter. One advantage of the apparatus according to the invention is the simplicity and the cost of clamping a few meters of cable for example (10-200 meter), compared to having an insulated gap in the tubing string or a centralizer system. Further, increases in signal strength may be economically provided by simply increasing the length of the conductive member 31.

Although the above description focuses mostly on transmitting from the surface to the downhole tool, the disclosure is equally applicable to transmitting signals from the downhole tool to the surface. Instead of (or in addition to) a receiver, the processing unit may include a transmitter, which is configured to encode a signal into a modulated current. In one embodiment, the receiver and transmitter may be combined to provide a transceiver. The modulated current is applied to the conductive member to inject the current into the casing and the surrounding formation at the upper measuring point and the lower measuring point. The signal propagates to the surface, where it is received by the surface processing unit that measures a voltage difference between the wellhead and some point on the ground a distance away from the wellhead. The surface processing unit processes the voltage difference and stores or transmits the received information.

The above-described electromagnetic telemetry system is suitable for most downhole tools deployed on a tubing string. Embodiments of the present invention may be used to replace systems that operate by pressure pulses by substituting the conductive member 31 and the processing unit 30 for a pressure sensor and corresponding electronics for interpreting signals encoded in pressure pulses. Suitable downhole tools include, for example, triggering tools for downhole explosives, such as those used to fracture a formation or perforate casing. Sample taking tools and valves may also be operated by electromagnetic telemetry systems in accordance with embodiments of the present invention.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A downhole electromagnetic telemetry unit for use with a tubing string, the downhole electromagnetic telemetry unit comprising:

an insulated electrically conductive member electrically coupled to the tubing string at an upper measuring point and a lower measuring point, wherein the electrically conductive member is a shielded cable; and a processing unit configured to process a voltage difference measured between the upper measuring point and the lower measuring point across the insulated electrically conductive member and to derive therefrom a signal transmitted from a surface location.

2. The downhole electromagnetic telemetry unit according to claim 1, wherein the shielded cable is clamped to the tubing string at the at least one upper measuring point and the at least one lower measuring point.

3. The downhole electromagnetic telemetry unit according to claim 1, wherein the upper measuring point and the lower measuring point are at least about 5 meters apart.

4. The downhole electromagnetic telemetry unit according to claim 1, wherein the upper measuring point and the lower measuring point are between about 10 meters and 200 meters apart.

5. The downhole electromagnetic telemetry unit according to claim 1 having a telemetrically controlled downhole tool configured to connect to the tubing string, and wherein the downhole tool is configured to be actuated by the signal transmitted from the surface location.

6. The telemetrically controlled downhole tool according to claim 5, wherein the lower measuring point is a housing of the downhole tool.

7. The telemetrically controlled downhole tool according to claim 5, wherein the downhole tool is one of a firing head, a remote valve, and a sampling tool.

8. The downhole electromagnetic telemetry unit according to claim 1, wherein the processing unit is configured to transmit a signal by applying a voltage difference between the upper measuring point and the lower measuring point across the insulated electrically conductive member.

* * * * *